US008513897B2

(12) United States Patent
Liao et al.

(10) Patent No.: US 8,513,897 B2
(45) Date of Patent: Aug. 20, 2013

(54) OLED DISPLAY WITH A CURRENT STABILIZING DEVICE AND ITS DRIVING METHOD

(75) Inventors: Yu-Pin Liao, Taichung (TW); Ying-Ju Liu, Taichung (TW); Chih-Wei Chiang, Taichung (TW)

(73) Assignee: Winstar Display Co., Ltd, Taichung (TW)

( * ) Notice: Subject to any disclaimer, the term of this patent is extended or adjusted under 35 U.S.C. 154(b) by 424 days.

(21) Appl. No.: 12/896,026

(22) Filed: Oct. 1, 2010

(65) Prior Publication Data

US 2012/0081034 A1 Apr. 5, 2012

(51) Int. Cl.
*H05B 37/02* (2006.01)

(52) U.S. Cl.
USPC ..... 315/291; 315/294; 315/247; 315/169.1; 315/312; 345/77; 345/82; 345/90; 345/204; 345/212

(58) Field of Classification Search
USPC ..... 315/169.1, 169.3, 291, 299, 301, 315/307, 247, 294, 300, 302, 312; 345/76, 345/77, 82, 84, 90, 211, 212, 204, 205, 690
See application file for complete search history.

(56) References Cited

U.S. PATENT DOCUMENTS

| | | | | |
|---|---|---|---|---|
| 6,373,454 | B1 * | 4/2002 | Knapp et al. | 345/76 |
| 7,456,579 | B2 * | 11/2008 | Yamazaki et al. | 315/169.3 |
| 7,978,187 | B2 * | 7/2011 | Nathan et al. | 345/204 |
| 8,217,866 | B2 * | 7/2012 | Ryu et al. | 345/77 |
| 2003/0146784 | A1 * | 8/2003 | LeChevalier | 327/538 |
| 2008/0150845 | A1 * | 6/2008 | Ishii et al. | 345/77 |
| 2009/0146926 | A1 * | 6/2009 | Sung et al. | 345/76 |

* cited by examiner

*Primary Examiner* — Haiss Philogene
(74) *Attorney, Agent, or Firm* — Banger Shia

(57) ABSTRACT

An OLED display with a current stabilizing device employs a current stabilizing device which is coupled between the driving-voltage line of the data driver and the data-power-supply wires to produce an output voltage higher than the driving voltage by boosting the driving voltage of the data driver, and then to maintain the current of the OLEDs at a constant level by performing current limiting, so that the problem of the current-ununiformity caused uneven luminance of the conventional OLED display can be solved, and the possibility that the luminance of the OLED panel will decay in a short period of time is reduce.

9 Claims, 5 Drawing Sheets

OLED DISPLAY WITH A CURRENT STABILIZING DEVICE AND ITS DRIVING METHOD

BACKGROUND OF THE INVENTION

1. Field of the Invention

The present invention relates to an OLED display, and more particularly to an OLED display with a current stabilizing device and its driving method.

2. Description of the Prior Art

OLED (Organic Light Emitting Diode) is current-driven device and its luminance is determined by the current intensity. Different levels of luminance (also called gray scale value) can be achieved by controlling the driving current of the OLED, therefore, the current stability is very important. Current uniformity problem will be caused if it fails to provide the OLED with stable current, which will further cause non-uniform illumination.

Referring to FIG. 1, which is a circuit block diagram of a conventional OLED, the conventional OLED comprises an OLED panel 11, a data driver 12 and a scan driver 13. The OLED panel 11 comprises y×x OLEDs 111, wherein the y and x are positive integers. The data driver 12 outputs a Y number of data current I1~Iy to the y rows (in the vertical direction) of OLEDs 111 via the output circuit (not shown), and then the x rows (in the horizontal direction) of OLEDs 111 produce a image-displaying light source needed by the OLED panel 11 based on the data current I1~Iy and the scan signals Com1~Comx outputted by the scan driver 13.

However, in the data driver 12, the power-supply circuit provides constant current I, and a y number of mirror circuits produce data current I1, I2, . . . Iy by multiple mirror reflection. In this case, the data power cables 121 usually should be very long, however, the fact that the data power cables 121 are excessively-long and different in length is an important factor causing uneven current intensities of the data current I1~Iy.

Furthermore, after the OLED panel 11 is used for a certain period of time, its OLEDs 111 will be deteriorated, which causes internal resistance increase and driving voltage decrease, and as a result, the luminance of the OLED panel 11 will deteriorate in a short length of time (approximately 2 years). As shown in FIG. 2, the curve indicates the reliability changes when the OLEDs are used in a high temperature and humidity environment, wherein internal resistance of the OLEDs increases and the luminance thereof linearly attenuates, namely, luminance decay by 50% (T50) from the initial luminance, which shortens the lifetime of the OLEDs. The phase indicated by the arrow is kind of a running-in period, which means that when the OLEDs are turned on for the first time, their initial luminance will gradually increase during this running-in period and then become constant. However, the curve climbs in the initial phase and then starts declining for the same reason as above. To resolve the problem of the running-in period, the OLEDs should usually be turned on until they become stabilized before being made into final products, which, however, shortens the lifetime of the OLEDs. Without the running-in period, the OLEDs will have the afterimage problem, for example, an initial content (such as ABC) displayed in an initial phase will remain in the full screen phrase, because the OLEDs constituting the initial content ABC are much brighter than those which are turned on afterwards.

The present invention has arisen to mitigate and/or obviate the afore-described disadvantages.

SUMMARY OF THE INVENTION

The primary object of the present invention is to provide an OLED display with a current stabilizing device and its driving method, which is capable of providing a stable current to the OLEDs to solve the problem of the current-ununiformity caused uneven luminance of the conventional OLED display.

Another object of the present invention is to provide an OLED display with a current stabilizing device and its driving method, which is capable of providing a stable output voltage which is higher than the driving voltage, so as to reduce the possibility that the luminance of the OLED panel will decay in a short period of time.

To achieve the above object, an organic light emitting diode display with a current stabilizing device provided by the present invention comprises an OLED panel, a data driver, a scan driver and a current stabilizing device. The organic light emitting diode panel is provided with a plurality of organic light emitting diodes, and each of the organic light emitting diodes comprises a negative electrode and a positive electrode. The data driver includes a driving-voltage line and a plurality of data-power-supply wires, the data-power-supply wires are coupled to the negative electrodes of the organic light emitting diodes. The scan driver includes a plurality of scan-signal lines coupled to the positive electrodes of the organic light emitting diodes. The current stabilizing device includes a voltage boosting unit and a current limiting unit, the voltage boosting unit is coupled to the driving-voltage line to boost a driving voltage of the data driver in order to produce an output voltage which is higher than the driving voltage, and the current limiting unit is coupled between the voltage boosting unit and the data-power-supply wires to maintain a data current flowing through the organic light emitting diodes at a constant level by performing current limiting to the output voltage.

The current stabilizing device is preferably mounted on an outer surface of the data driver.

The current stabilizing device is preferably installed in the data driver.

Moreover, a driving method for stabilizing the current of an organic light emitting diode in accordance with the present invention comprises:

coupling a current stabilizing device between a driving-voltage line and data-power-supply wires of a data driver;

using the current stabilizing device to boost a driving voltage of the data driver in order to produce an output voltage higher than the driving voltage; and using the current stabilizing device to maintain the current of the organic light emitting diodes at a constant level by performing current limiting.

The current stabilizing device includes a voltage boosting unit and a current limiting unit, the voltage boosting unit is coupled to a driving-voltage line of the data driver to boost the driving voltage of the data driver, the current limiting unit is coupled between the voltage boosting unit and the data-power-supply wires to perform current limiting to the output voltage.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
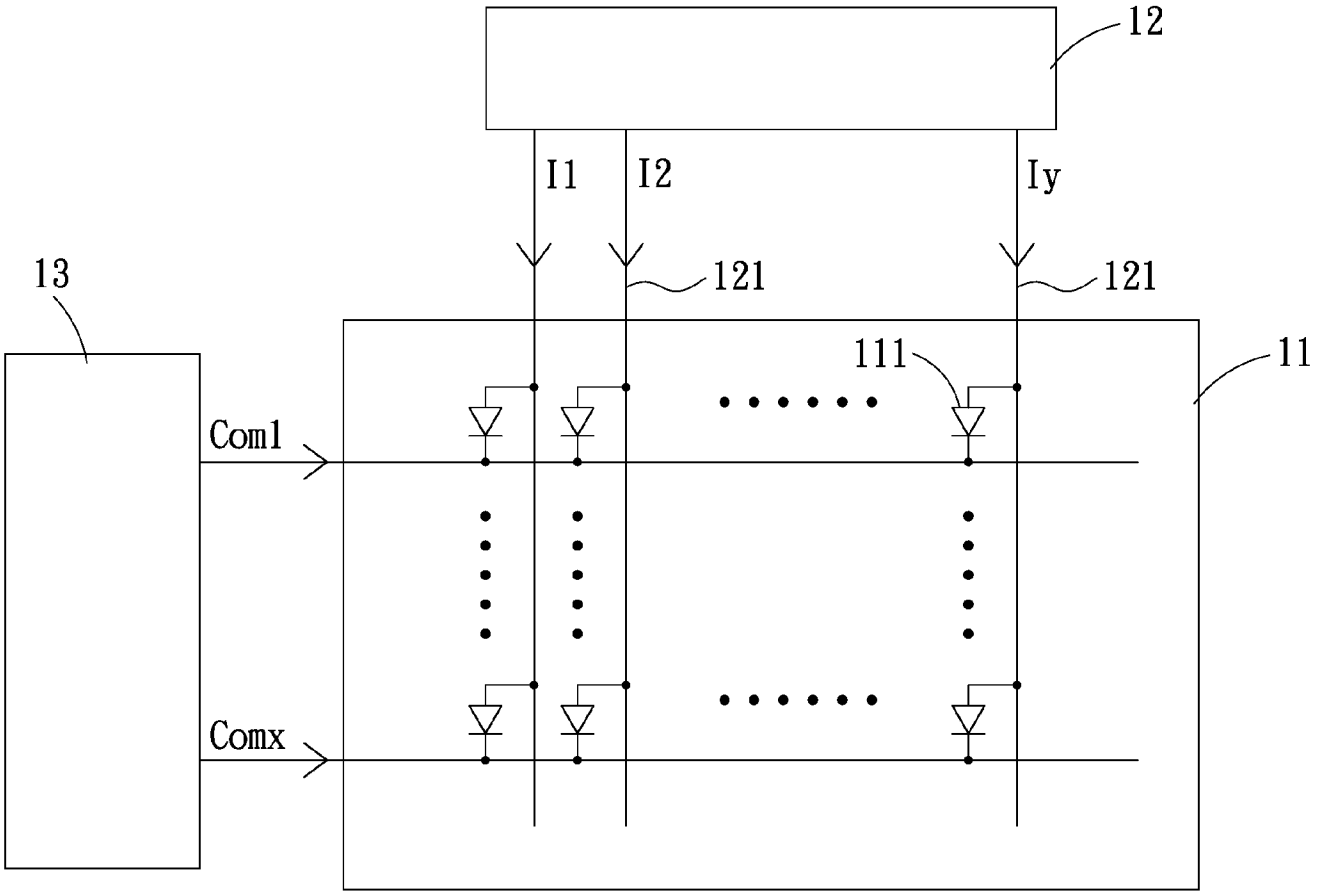
FIG. 1 PRIOR ART
FIG. 1 is a circuit block diagram of a conventional OLED.
Figure 2:
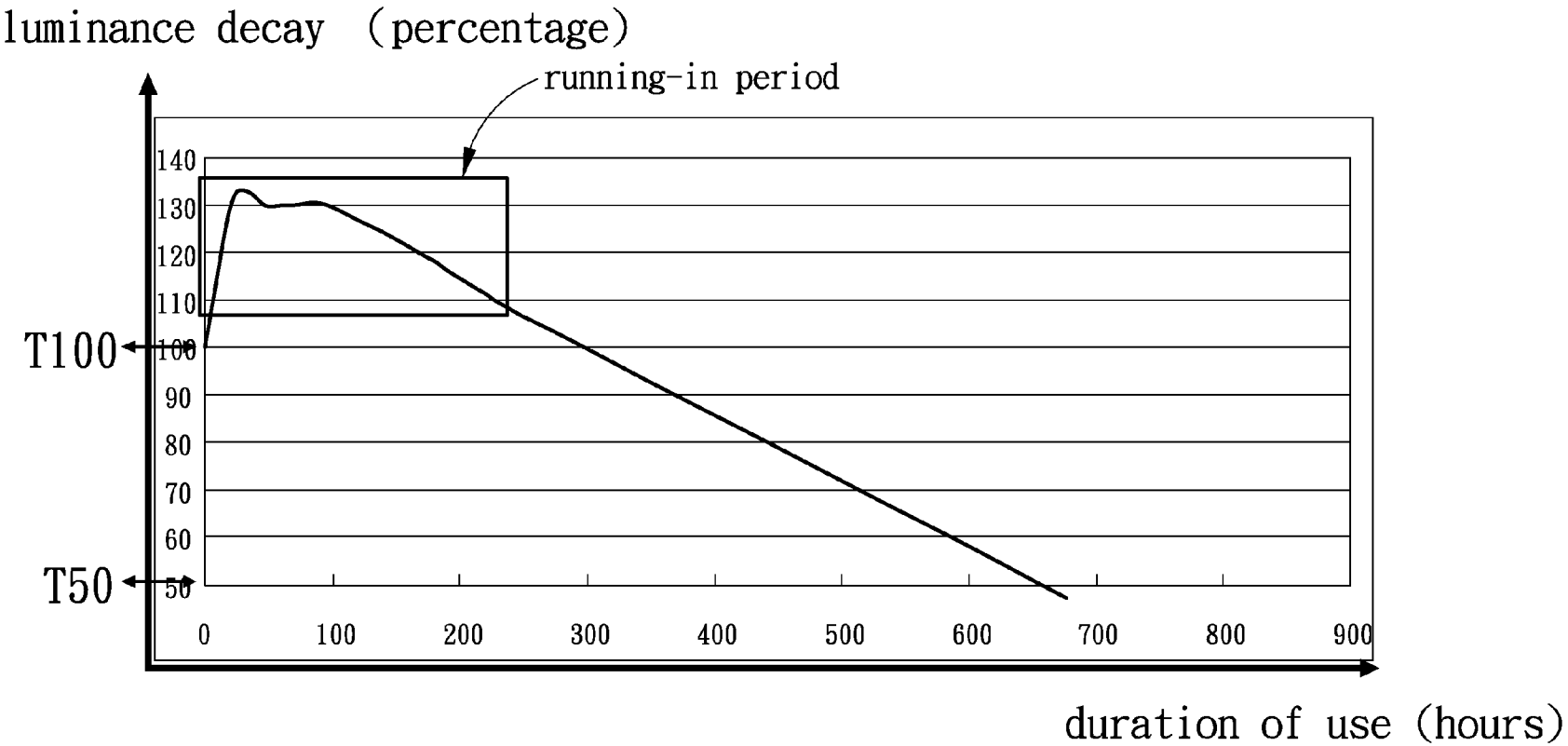
FIG. 2 PRIOR ART
FIG. 2 is an operation diagram of the conventional OLED.
Figure 3:
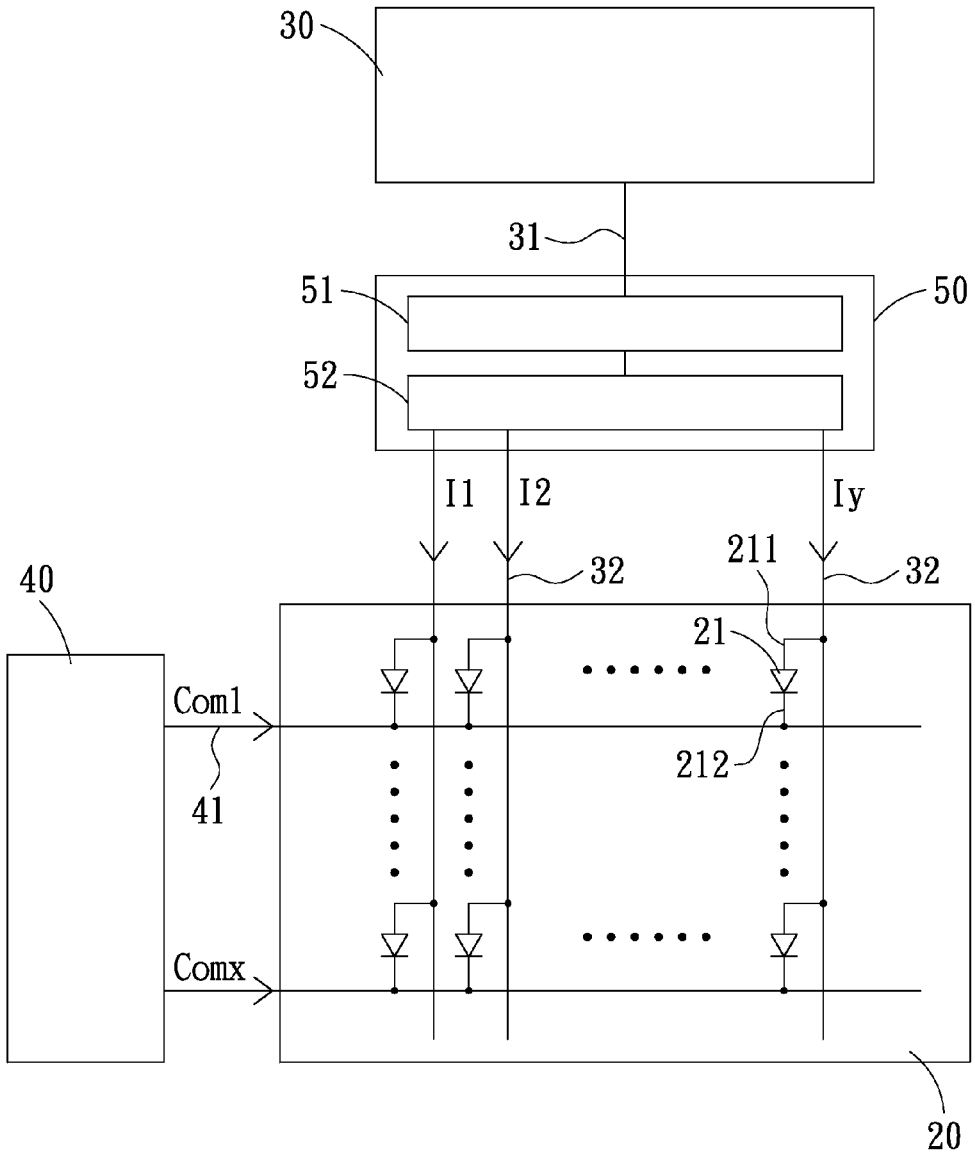
FIG. 3 is a circuit block diagram of an OLED display with a current stabilizing device in accordance with the present invention.

Referring to FIG. 3, an OLED display with a current stabilizing device in accordance with the present invention can be a passive matrix OLED display or a positive matrix OLED display and comprises: an OLED panel 20, a data driver 30, a scan driver 40 and a current stabilizing device 50.

The OLED panel 20 is provided in x and y directions with an x×y number of spaced-apart OLEDs 21, and each of the OLEDs 21 includes a negative electrode 211 and a positive electrode 212. The horizontal and longitudinal directions in FIG. 3 are defined as x and y directions, respectively.

The data driver 30 includes a driving-voltage line 31 and a plurality of data-power-supply wires 32. The driving-voltage line 31 outputs a driving voltage, and the data-power-supply wires 32 are coupled to the negative electrodes 211 of the OLEDs 21 in the y direction.

The scan driver 40 includes a plurality of scan-signal lines 41 which are coupled to the positive electrodes 212 of the OLEDs 21 in the x direction to provide the OLEDs 21 the scan signals Com1~Comx.

The current stabilizing device 50 in this embodiment is mounted on an outer surface of the data driver 30 for example and comprises a voltage boosting unit 51 and a current limiting unit 52. The voltage boosting unit 51 is coupled to the driving-voltage line 31 to produce an output voltage which is higher than the driving voltage but still within the voltage range of the OLEDs 21 by boosting the driving voltage of the data driver 30. The current limiting unit 52 is coupled between the voltage boosting unit 51 and the data-power-supply wires 32 to maintain the data current I1~Iy flowing through the OLEDs 21 at a desired level by performing current limiting to the output voltage.

It is to be noted that the current limiting unit 52 of the current stabilizing device 50 coupled between the driving-voltage line 31 and the data-power-supply wires 32 employs a comparator to compare the current flowing through the current limiting unit 52 with a predetermined reference current value, and then outputs a stable current by controlling the connection resistance of a transistor, maintaining the data current I1~In flowing through the OLEDs 21 at a constant level. Since the circuits forming the current limiting unit 52 are conventional and have various forms, any circuits having similar or equivalent function as the current limiting unit 52 would be considered as falling the scope of the present invention, and similarly, circuits having similar or equivalent function as the voltage boosting unit 51 would be considered as falling the scope of the present invention.

Due to the fact that the current stabilizing device 50 coupled between the driving-voltage line 31 and the data-power-supply wires 32 employs the voltage boosting unit 51 to boost the driving voltage of the data driver 30, and the output voltage after boosting is larger than the product of the minimum driving current required by the OLEDs 21 and the maximum connection resistance of the data-power-supply wires 32 and is then transmitted to the current limiting unit 52 to do current limiting, the driving current required to drive the OLEDs 21 will be constant
and stable without being affected by the power-supply voltage drop caused that the data-power-supply wires 32 being too long or having different lengths. Hence, the problem of current uniformity can be solved.

On the other hand, after the OLED panel 20 works for a period of time, its OLEDs 21 will be deteriorated and cause internal resistance increase, since the voltage boosting unit 51 of the current stabilizing device 50 outputs an output voltage which is higher than the driving voltage by boosting the driving voltage of the data driver 30, the output voltage will still be sufficient to drive the OLEDs 21 without the problem that the deterioration-caused internal resistance will affect the driving voltage required to drive the OLEDs 21, and thus preventing the luminance of the OLED panel 20 from decaying in a short period of time, namely, extending lifetime of the OLED panel 20.

Figure 4:
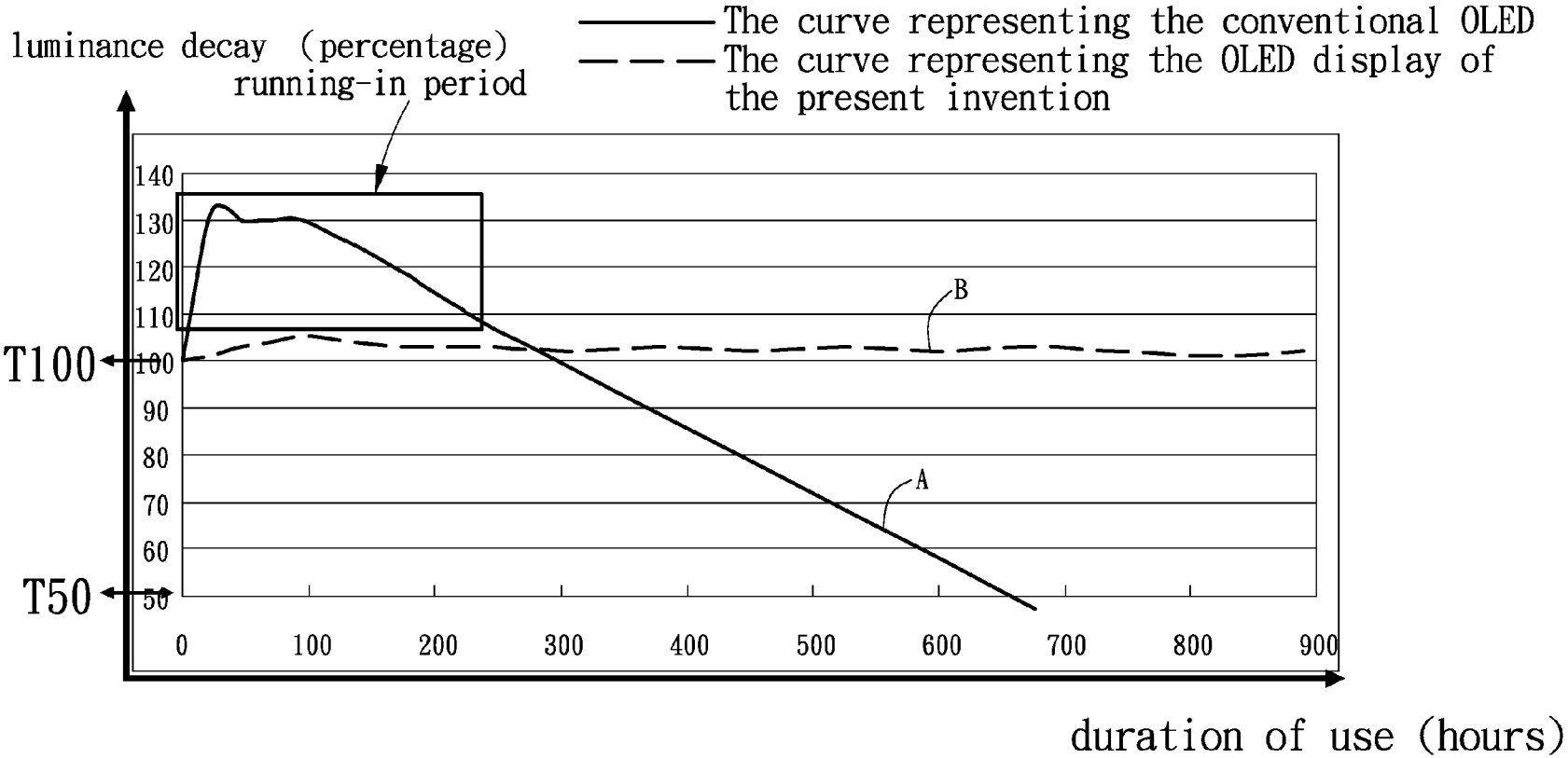
FIG. 4 is a comparative diagram showing the difference between the OLED display with a current stabilizing device in accordance with the present invention and the conventional OLED.
Figure 5:
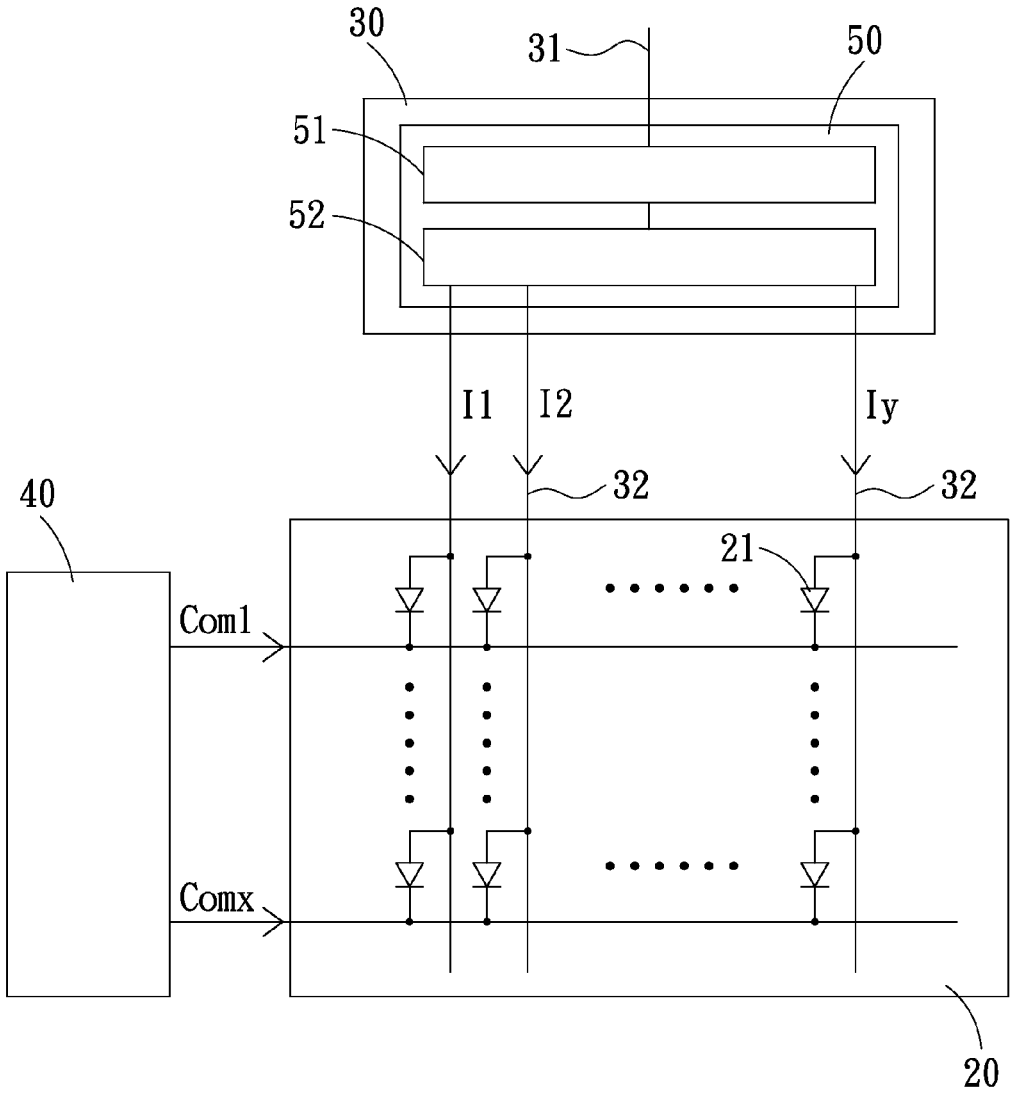
FIG. 5 is circuit block diagram of another OLED display with a current stabilizing device in accordance with the present invention.

Referring to FIG. 4, which is a comparative diagram, the curves indicate the reliability changes when the different OLEDs are used in high temperature and humidity environments. The curve A shows the reliability changes of a conventional OLED, and the curve B shows the reliability changes of an OLED of the present invention. Due to the fact that the present invention increases the required energy (boosting the voltage) and then provides stable current to the OLEDs after doing current limiting, the energy provided to the OLEDs is accordingly stable without going through the running-in period, the running-in period can be effectively used and the afterimage problem can also be solved, the lifetime of the OLEDs is extended. Furthermore, the present invention prepares the required energy in advance and then, under the condition that the OLEDs decay after long time of use and cause internal resistance increase, is still able to effectively provide stable current to enable the OLEDs to emit light at high luminance and extend the lifetime of the OLEDs until the organic material is used up.

The present invention further provides a driving method for stabilizing the current of an OLED display by coupling a current stabilizing device between the driving-voltage line of the data driver and the data-power-supply wires, the current stabilizing device produces an output voltage which is higher than the driving voltage by boosting the driving voltage of the data driver, and then maintains the current of the OLEDs at a constant level by performing current limiting. More particularly, the current stabilizing device comprises a voltage boosting unit and a current limiting unit. The voltage boosting unit is coupled is coupled to the driving-voltage line of the data driver to boost the driving voltage of the data driver, and the current limiting unit is coupled between the voltage boosting unit and the data-power-supply wires to perform current limiting to the output voltage.

In addition to being mounted on the outer surface of the data driver 30, the current stabilizing device 50 can also be installed in the data driver 30 in such a manner that the voltage boosting unit 51 is coupled to the driving-voltage line 31 to boost the driving voltage of the data driver 30, and the current limiting unit 52 is coupled to the voltage boosting unit 51 and the data-power-supply wires 32 to do current limiting to the output voltage.

While we have shown and described various embodiments in accordance with the present invention, it is clear to those skilled in the art that further embodiments may be made without departing from the scope of the present invention.

What is claimed is:

1. An organic light emitting diode display with a current stabilizing device comprising:

an organic light emitting diode panel being provided with a plurality of organic light emitting diodes, and each of the organic light emitting diodes including a negative electrode and a positive electrode;

a data driver including a driving-voltage line and a plurality of data-power-supply wires, the data-power-supply wires being coupled to the negative electrodes of the organic light emitting diodes;

a scan driver including a plurality of scan-signal lines coupled to the positive electrodes of the organic light emitting diodes;

a current stabilizing device including a voltage boosting unit and a current limiting unit, the voltage boosting unit being coupled to the driving-voltage line to boost a driving voltage of the data driver in order to produce an output voltage which is higher than the driving voltage, the current limiting unit being coupled between the voltage boosting unit and the data-power-supply wires to maintain a data current flowing through the organic light emitting diodes at a constant level by performing current limiting to the output voltage;

wherein the current limiting unit and the voltage boosting unit are installed in same stabilizing device, which was controlled by connection resistance of a transistor.

2. The organic light emitting diode display with a current stabilizing device as claimed in claim 1, wherein the current stabilizing device is mounted on an outer surface of the data driver.

3. The organic light emitting diode display with a current stabilizing device as claimed in claim 1, wherein the current stabilizing device is installed in the data driver.

4. An organic light emitting diode display with a current stabilizing device comprising:

an organic light emitting diode panel being provided with a plurality of organic light emitting diodes;

a data driver being coupled to the organic light emitting diodes;

a scan driver being coupled to the organic light emitting diodes;

a current stabilizing device including a voltage boosting unit and a current limiting unit, the voltage boosting unit being coupled to the data driver, the current limiting unit being coupled between the voltage boosting unit and the data driver to maintain a data current flowing through the organic light emitting diodes;

wherein a current limiting unit and a voltage boosting unit are installed in same stabilizing device, which was controlled by connection resistance of a transistor, the voltage boosting unit is coupled to a driving-voltage line of the data driver to boost the driving voltage of the data driver, the current limiting unit is coupled between the voltage boosting unit and the data-power-supply wires to perform current limiting to the output voltage.

5. The organic light emitting diode display with a current stabilizing device as claimed in claim 4, wherein the current stabilizing device is mounted on an outer surface of the data driver.

6. The organic light emitting diode display with a current stabilizing device as claimed in claim 5, wherein the current stabilizing device is installed in the data driver.

7. An organic light emitting diode display with a current stabilizing device comprising:

an organic light emitting diode panel being provided with a plurality of organic light emitting diodes, and each of the organic light emitting diodes including a negative electrode and a positive electrode;

a data driver including a driving-voltage line and a plurality of data-power-supply wires, the data-power-supply wires being coupled to the negative electrodes of the organic light emitting diodes;

a scan driver including a plurality of scan-signal lines coupled to the positive electrodes of the organic light emitting diodes;

a current stabilizing device including a voltage boosting unit and a current limiting unit, the voltage boosting unit being coupled to the driving-voltage line to boost a driving voltage of the data driver in order to produce an output voltage which is higher than the driving voltage, the current limiting unit being coupled between the voltage boosting unit and the data-power-supply wires to maintain a data current flowing through the organic light emitting diodes at a constant level by performing current limiting to the output voltage;

wherein a current limiting unit and a voltage boosting unit are installed in same stabilizing device, which was controlled by connection resistance of a transistor, the voltage boosting unit is coupled to a driving-voltage line of the data driver to boost the driving voltage of the data driver, the current limiting unit is coupled between the voltage boosting unit and the data-power-supply wires to perform current limiting to the output voltage.

8. The organic light emitting diode display with a current stabilizing device as claimed in claim 7, wherein the current stabilizing device is mounted on an outer surface of the data driver.

9. The organic light emitting diode display with a current stabilizing device as claimed in claim 7, wherein the current stabilizing device is installed in the data driver.

* * * * *